US011156358B2

(12) United States Patent
Dhyllon

(10) Patent No.: US 11,156,358 B2
(45) Date of Patent: Oct. 26, 2021

(54) FURNACE APPARATUS

(71) Applicant: Serendipity Technologies LLC, Wynnewood, PA (US)

(72) Inventor: Amen Dhyllon, Wynnewood, PA (US)

(73) Assignee: Serendipity Technologies LLC, Wynnewood, PA (US)

( * ) Notice: Subject to any disclaimer, the term of this patent is extended or adjusted under 35 U.S.C. 154(b) by 205 days.

(21) Appl. No.: 16/578,439

(22) Filed: Sep. 23, 2019

(65) Prior Publication Data

US 2020/0158335 A1 May 21, 2020

Related U.S. Application Data

(60) Provisional application No. 62/769,610, filed on Nov. 20, 2018.

(51) Int. Cl.

| | |
|---|---|
| ***F23G 5/027*** | (2006.01) |
| ***F23G 5/10*** | (2006.01) |
| ***F23G 5/32*** | (2006.01) |
| ***F23G 5/46*** | (2006.01) |
| ***F23G 7/06*** | (2006.01) |

(52) U.S. Cl.

CPC ..... *F23G 5/0276* (2013.01); *F23G 5/10* (2013.01); *F23G 5/32* (2013.01); *F23G 5/46* (2013.01); *F23G 7/061* (2013.01); *F23G 2202/703* (2013.01); *F23G 2203/30* (2013.01); *F23G 2204/20* (2013.01); *F23G 2207/30* (2013.01)

(58) Field of Classification Search

CPC ..... F23G 5/0276; F23G 5/10; F23G 2207/30; F23G 2202/703; F23G 2204/20

See application file for complete search history.

(56) References Cited

U.S. PATENT DOCUMENTS

| | | | | |
|---|---|---|---|---|
| 2,586,752 A | | 2/1952 | Weber et al. | |
| 3,084,064 A | * | 4/1963 | Cowden | C23C 4/06 428/639 |
| 4,123,481 A | * | 10/1978 | Herold | F23D 11/345 261/81 |
| 4,308,006 A | * | 12/1981 | Koblanski | E02B 15/042 431/1 |
| 9,518,733 B1 | * | 12/2016 | Dhyllon | F23G 5/24 |
| 2019/0082887 A1 | * | 3/2019 | Farrell | A47J 37/079 |

FOREIGN PATENT DOCUMENTS

| | | |
|---|---|---|
| AU | 2018267615 | 11/2018 |

* cited by examiner

*Primary Examiner* — David J Laux

(74) *Attorney, Agent, or Firm* — Adam Warwick Bell; Matthew Rupert Kaser

(57) ABSTRACT

An improved systems and methods to reduce and remove particulate matter and chemical pollutants from flue gasses. Specifically, the invention relates to waste incinerator furnaces and devices and methods for improved combustion, destruction and removal of undesirable particulate and gaseous environmental contaminants and pollutants.

10 Claims, 17 Drawing Sheets

FURNACE APPARATUS

RELATIONSHIP TO OTHER APPLICATIONS AND INCORPORATION BY REFERENCE

The present application claims the benefit of U.S. provisional application No. 62/769,610 filed 20 Nov. 2018. All documents, patents, applications and publications mentioned in this disclosure are hereby incorporated by reference.

FIELD OF THE INVENTION

The disclosure relates to waste incinerator furnaces and devices and methods for improved combustion, destruction and potential removal of undesirable particulate and gaseous environmental contaminants and pollutants.

BACKGROUND

Air pollution prevention and control is one of the most pressing issues in environmental policy today. Particulate matter (PM), also known as particle pollution, is a complex mixture of extremely small particles and liquid droplets that get into the air. Once inhaled, these particles can affect the heart and lungs and cause serious health effects. EPA regulates inhalable particles. Particles of sand and large dust, which are larger than 10 micrometers, are not regulated by EPA. The Clean Air Act, which was last amended in 1990, requires EPA to set National Ambient Air Quality Standards (40 CFR part 50) for pollutants considered harmful to public health and the environment. The Clean Air Act identifies two types of national ambient air quality standards. Primary standards provide public health protection, including protecting the health of "sensitive" populations such as asthmatics, children, and the elderly. Secondary standards provide public welfare protection, including protection against decreased visibility and damage to animals, crops, vegetation, and buildings. The Air Quality Index (AQI) tells you how clean or polluted your outdoor air is, along with associated health effects that may be of concern. The AQI translates air quality data into numbers and colors that help people understand when to take action to protect their health.

The US and Europe have adopted strict pollution control legislation based on measurable emission standards. For example, the US EPA provides standards set out in the National Ambient Air Quality Standards (40 CFR part 50).

Incinerators have the potential to produce a great deal of particulate pollutants and other environmental contaminants. The EPA sets out regulation for Commercial and Industrial Solid Waste Incineration Units (CISWI). Section 129 of the Clean Air Act directs the Administrator to develop regulations under section 111 of the Act limiting emissions of nine air pollutants (i.e., particulate matter, carbon monoxide, dioxins/furans, sulfur dioxide, nitrogen oxides, hydrogen chloride, lead, mercury, and cadmium) from four categories of solid waste incineration units: municipal solid waste; hospital, medical and infectious solid waste; commercial and industrial solid waste; and other solid waste.

EPA promulgated the new source performance standards (NSPS) and emission guidelines (EG) to reduce air pollution from commercial and industrial solid waste incineration (CISWI) units, for Subparts CCCC and DDDD on Dec. 1, 2000. Those standards and guidelines applied to incinerators used by commercial and industrial facilities to burn non-hazardous solid waste. The NSPS and EG were designed to substantially reduce emissions of a number of harmful air pollutants such as lead, cadmium, mercury, and dioxins/furans, which are known or suspected to cause adverse health and environmental effects.

In 2011, EPA promulgated the revised NSPS and EG to address voluntary remand that was granted in 2001 and the vacatur of the CISWI definition rule in 2007. In addition, the revised standards accounted for the 5-year technology review of the new source performance standards and emission guidelines required under Section 129. Following promulgation of the 2011 CISWI rule, EPA received petitions for reconsideration requesting to reconsider numerous provisions in the 2011 CISWI rule. EPA granted reconsiderations on specific issues and promulgated CISWI reconsideration rule on Feb. 7, 2013. Subsequently, EPA received petitions to further reconsider certain provisions of the 2013 NSPS and EG for CISWI units. On Jan. 21, 2015, EPA granted reconsideration on four specific issues and finalized the reconsideration of the CISWI NSPS and EG on Jun. 2, 2016.

The European The Waste Incineration Directive (WI Directive) is designed to prevent or to reduce as far as possible negative effects on the environment caused by the incineration and co-incineration of waste. In particular, it should reduce pollution caused by emissions into the air, soil, surface water and groundwater, and thus lessen the risks which these pose to human health. This is to be achieved through the application of operational conditions, technical requirements, and emission limit values for incineration and co-incineration plants within the EU. The WI Directive sets emission limit values and monitoring requirements for pollutants to air such as dust, nitrogen oxides (NOx), sulphur dioxide (SO2), hydrogen chloride (HCl), hydrogen fluoride (HF), heavy metals and dioxins and furans. The Directive also sets controls on releases to water resulting from the treatment of the waste gasses. Most types of waste incineration plants fall within the scope of the WI Directive, with some exceptions, such as those treating only biomass (e.g. vegetable waste from agriculture and forestry). Experimental plants with a limited capacity used for research and development of improved incineration processes are also excluded.

Particulate matter and other pollutants produced from waste incineration is under particular scrutiny. Particles smaller than 10 μm (PM10) & 2.5 μm (PM2.5) are associated with a range of respiratory and cardiovascular diseases. Overall collection efficiency of air pollution control devices depends on particle size distribution (PSD).

The cost of air pollution is enormous in terms of health care and environmental remediation. See FIG. 9. For example, in Singapore, it is estimated that the total economic cost US $3662 million is about 4.31% of Singapore's GDP in 1999. A 2013 study calculated that approximately 200,000 early deaths occur every year in the United States because of air pollution. The OECD in 2015 estimated that 3.5 million deaths per year are attributable to air pollution. See FIG. 7.

Waste incinerators employ a variety of methods to clean flue gasses, and to remove both gaseous and particulate contaminants. The combustion of waste results in the production of a mixture of gasses containing pollutants such as carbon dioxide, sulphur dioxide, dust and soot, as well as nitrogen oxides, heavy metal bearing fumes and unburned hydrocarbons. Flue-gas cleaning methods include the following well-known systems:

Cyclone

In the flue gas cleaning process, cyclones are used for pre-separation of solid materials. This involves removal of coarse dust from the flue gas for the benefit of the downstream flue gas cleaning steps. The centrifugal force is used to separate solids in a cyclone. This force is developed by rotation of the incoming flue gas, resulting in the dust particles getting hurled onto the outer walls. These then sink and fall into a receiving vessel. The speed of rotation of the gas determines how effective the separation is—the faster the rotation the more efficient the separation. 100 percent separation efficiency is however not achieved with cyclones. The process is used to pre-clean the flue gasses before the next purification steps.

Electrostatic Precipitator

Electrostatic precipitators are composed of several rows of negative spray electrodes and positive precipitating electrodes. A DC voltage of 20-100 kV is applied between these two electrode types. An electrostatic charge is induced in the dust particles, which then move towards the precipitating electrode where they are collected. Electrostatic precipitators are robust, low-maintenance devices, offering high availability. Precipitator efficiencies of over 99.8 percent can be achieved with multi-zone electrostatic precipitators. Excellent efficiency is maintained even if the proportion of solids in the flue gas stream is extraordinarily high. This is for example the case when the flue gas stream contains particles of the reaction products from a spray absorption or dust-like ashes from a steam generator. An electrical precipitator is however not suitable for removal of gaseous pollutants.

Wet Precipitator

Wet precipitators are mainly used for cleaning waste gasses from chemical processes—rarely in waste incineration plants. Structure and function is basically the same as that of the dry precipitator, apart from the fact that a liquid film is formed at the precipitating electrodes, which rinses off the solid particles continuously. Wet precipitators are mainly used for cleaning steam-saturated gasses. Good separation efficiency for aerosols and particulates is achieved in combination with wet scrubbers or other flue gas cleaning components.

Fabric Filter (Baghouse Filter)

Fabric filters have been used in flue gas cleaning systems for over 15 years. They are mainly used to separate solid as well as, to a small extent, gaseous components. Fabric filters are positioned downstream of a spray absorber/spray dryer or a dry gas cleaning system such as lime injection. A fabric filter system consists of several chambers in series, which are separated from each other by closing flaps. Fabric bags made of glass, mineral, metal as well as natural or artificial fibers are suspended in the chambers. The flue gas diffuses through the solid layer deposited on the fabric bag. In this way, not only fine dusts, but also gaseous pollutants can be removed. This is achieved by injection of dry lime or by means of the unreacted lime proportion after a lime milk operated spray absorber. Fabric filters have recently gained importance in connection with entrained-bed adsorption methods such as injection of hearth-furnace coke or activated carbon for removal of dioxin and vaporous heavy metals.

Selective Non-Catalytic Reaction (SNCR)

This process converts nitrogen oxides to environmentally neutral nitrogen and water by addition of ammonia water. In contrast to the SCR process, no catalyst is required in this process. Aqueous ammonia is fed through lances with nozzles all over the surface of several levels situated above the furnace chamber. Each feed level is supplied with a solution adapted to the temperature level, appropriately mixed beforehand in several mixing containers. Steam or compressed air are used as cooling and nebulizing medium. The denitrogenation process takes place within a relatively narrow temperature range between 850° C. and 1050° C., with the residence time of the nozzle-fed solutions also playing a significant role. This is why the flue gas temperature in the first boiler pass is measured by means of sound waves. If the gas temperature is too high, the undesirable nitrogen oxide resulting from the combustion of ammonia may be produced. A uniform temperature profile across the nozzle feed levels as well as an adequate reaction path within this narrow temperature range is therefore important. This process is computer-assisted in EEW Energy from Waste plants. On the basis of the readings from three alternative nozzle feed levels, the computer selects the one with the right temperature window. In order to achieve a maximum separation efficiency, more ammonia solution is fed through the nozzles than is consumed. Excess quantities are removed again in the subsequent flue gas cleaning procedure.

Selective Catalytic Reduction (SCR)

In contrast to the SNCR process, this process requires a catalyst. The flue gas flows through a reactor tower containing several levels with plate or honeycomb type catalysts, with ammonia solution fed through nozzles. If denitrogenation is carried out at the beginning of the flue gas cleaning process, plate-type catalysts are used since the flue gas could still contain dust particles. Honeycomb-type catalysts are mainly used for pure, dust-free gas at the end of the flue gas cleaning process. The catalysts are installed in the reactor tower at several levels using a modular construction system. The ceramic structures are covered with catalytic materials such as titanium-vanadium or tungsten oxide. The degree of nitrogen reduction is influenced by the catalytic action of the substance as well as the catalyst volume. The reaction temperature, which is currently most favorable between 300° C. and 400° C., is also significant. Efforts are however being made to try to operate the catalyst at a flue gas temperature which is as low as possible (320° C.), while achieving the same nitrogen oxide reduction result. Higher temperatures would require additional fuel to compensate the energy losses in the process chain. At a temperature below 320° C., ammonia salts are formed by the nozzle fed ammonia solution. This could block the catalysts. These salts are however not formed above 320° C.

HCl Scrubber/SO2 Scrubber

Wet cleaning systems are generally made use of after effective removal of dusts from the flue gas. The washing process allows achievement of good separation efficiencies for hydrogen chloride and Sulphur dioxide as well as for particle-bound, vaporous heavy metals such as mercury and cadmium. At least two cleaning stages are required for effective flue gas scrubbing. The reason for this is that some pollutants (hydrochloric acid, hydrogen fluoride, heavy metals) require acid conditions (pH of around 1) for successful removal, while others (Sulphur dioxide) require neutral conditions (pH around 7). Incoming flue gasses are led into a narrow steel container and cooled to 70° C. At this stage, good cleaning results are already achieved for water soluble components. The scrubbers have a large baffle structure area, i.e. an enlarged surface area, which ensures that the flue gasses are intensively mixed with the cleaning fluid. The waste water created in the process is concentrated by evaporation to allow safe removal of the pollutants contained.

Spray Absorbers/Spray Dryers

Spray absorbers/spray dryers are chiefly used for removing gaseous pollutants from the flue gas. The pollutants are converted to solid salts by addition of an absorption solution. In addition, a large proportion of vaporous heavy metals condenses on the solid particle surfaces. Turbulences in the incoming gas are achieved by means of deflector plates in the spray absorber. The absorption solution is introduced to the gas stream through annular nozzles. The solution is generally an aqueous lime solution nebulized to form a mist. The pollutants are bound to the lime after evaporation of the water. No waste water is therefore created. A specific temperature gradient is required for the spray absorber to work. The lower the initial temperature of the flue gas on emergence, the better the condensation of the vaporous heavy metals on the surface of the solid particles.

The efficiency of removal of particulate contaminants varies with method and with particle size. The collection efficiencies of cyclone separator, bag filter and electrostatic precipitator for various particle diameters are shown in FIG. 10.

Collection efficiencies of three air pollution control devices (Cyclone-ESP, Cyclone-BH and BH-ESP). arranged in series are presented below. When control devices are used in combination their collection efficiency improves. See FIG. 11.

As particle size decreases, collection efficiency decreases exponentially with a maximum efficiency of only 50% at very small particle sizes.

Clearly there is a need for improved systems to reduce and remove particulate matter and chemical pollutants from flue gasses.

BRIEF DESCRIPTION

Embodiments provide improved systems and methods to reduce and remove particulate matter and chemical pollutants from flue gasses. Certain embodiments may provide an improvement to the disclosure of patent application PCT/US/1644931 and U.S. Pat. No. 9,518,733. Embodiments may help to remove and destroy particulate matter and chemical pollutants such as dioxins from flue gasses, and reduces or eliminates $SO_2$ and NOx emissions.

An embodiment relates to a furnace apparatus configured to incinerate solid waste, comprising;

- a chamber comprising an upper pyrolysis section and a lower combustion section;
- a solid waste feed inlet positioned at an upper portion of the chamber configured to feed solid waste to the lower combustion section;
- a plurality of air inlet pipes fixedly connected to a lower portion of the chamber to receive air for combustion of the solid waste within the lower combustion section; and
- a plurality of air outlet pipes fixedly connected to the lower portion of the chamber and opposingly positioned to the air inlet pipes to exhaust combusted air from the lower combustion section, wherein a plurality of magnets are operably attached on the air inlet pipes and the air outlet pipes, wherein paramagnetic oxygen present in the received air is concentrated via the magnets, and the concentrated oxygen is introduced into a plasma generated within the combustion section to accelerate the combustion process, and to oxidize toxic matter present in the solid waste;
- the furnace apparatus further comprising nickel-chromium alloy conductors coated with a magnesium and/or graphite composite positioned within the lower combustion section, wherein the conductors are adapted to retain and conduct heat,
- and wherein the apparatus further comprises a chamber fitted with an ultrasonic generator wherein gasses are subjected to an ultrasonic frequency, wherein the ultrasonic generator is a vibrating ceramic plate.

The conductors may be adapted to conduct an electric current from an external source to provide heat in the combustion chamber.

The lower combustion section may be at least partially encapsulated with an insulating silica carbide coating.

The exhaust assembly may be further connected to a fan mechanism that propels the flue gasses into a process heater adapted to heat up the flue gasses up to about 1200° C.

The fan may be a cyclone fan producing an outer vortex of downward flowing air and an inner vortex of upward flowing air.

The furnace apparatus may further comprise a low speed fan that propels the gasses from the process heater into a Zeolite chamber to absorb any residual moisture from the gasses.

The furnace apparatus may further comprise a chamber fitted with ultrasonic generators wherein the gasses are subjected to an ultrasonic frequency to produce a fine mist from any vapour or liquid present.

After processing, the exhaust gasses may contain no detectable dioxins and no detectable particles of a size above 10 μm, or in other embodiments none larger than 2.5 μm.

The nickel-chromium alloy conductors may be coated with a magnesium and/or graphite composite line at least a portion of the inside of the lower combustion section.

The nickel-chromium alloy conductors may be adapted for thermal to insulation and are positioned between a silica carbide coating and an outer stainless-steel wall.

A further embodiment relates to a furnace apparatus configured to incinerate solid waste, comprising;

- a chamber comprising an upper pyrolysis section and a lower combustion section;
- a solid waste feed inlet positioned at an upper portion of the chamber configured to feed solid waste to the lower combustion section;
- a plurality of air inlet pipes fixedly connected to a lower portion of the chamber (the combustion chamber) to receive air for combustion of the solid waste within the lower combustion section; and
- a plurality of air outlet pipes fixedly connected to the lower portion of the chamber and positioned opposed to the air inlet pipes to exhaust combusted air from the lower combustion section, wherein a blower and a magnetic air separator is functionally in communication with the air inlet pipes, wherein paramagnetic oxygen present in the received air is concentrated via the magnetic air separator, and the concentrated oxygen is introduced into a plasma generated within the combustion section to accelerate the combustion process, and to oxidize toxic matter present in the solid waste;
- wherein the apparatus further comprises a chamber fitted with an ultrasonic generator wherein gasses are subjected to an ultrasonic frequency, wherein the ultrasonic generator is a vibrating ceramic plate.

The magnetic air separator may separate atmospheric air into $O_2$ enriched air and $N_2$ enriched air, wherein the $O_2$ enriched air is directed into the combustion chamber and the $N_2$ enriched air is directed away from the combustion chamber.

The lower combustion chamber may be at least partially encapsulated with an insulating silica carbide coating.

The exhaust assembly may be further connected to a fan mechanism that propels the flue gasses into a process heater adapted to heat up the flue gasses up to about 1200° C.

The fan may be a cyclone fan producing an outer vortex of downward flowing air and an inner vortex of upward flowing air.

The furnace apparatus may further comprise a low speed fan that propels the gasses from the process heater into a Zeolite chamber to absorb any residual moisture from the gasses.

The furnace apparatus may further comprise a chamber fitted with ultrasonic generators wherein the gasses are subjected to an ultrasonic frequency to eliminate any residual contaminants.

After processing, the exhaust gasses may contain no detectable dioxins and no detectable particles of a size above 10 μm, or in other embodiments, none larger than 2.5 μm.

The nickel-chromium alloy conductors may be coated with a magnesium and/or graphite composite line at least a portion of the inside of the lower combustion section.

The vibrating ceramic plate may vibrate at a frequency of about 1.7 mhz.

BRIEF DESCRIPTION OF THE FIGURES

Description of the prior-art as described in FIGS. 1-6. FIG. 1A exemplarily illustrates is a front perspective of the furnace apparatus 100, and shows a perspective view of the air inlet pipe 105 with magnets 112 positioned on the surface, FIG. 1C exemplarily illustrates is an enlarged view of the portion marked A in FIG. 1A which shows a perspective view of one of the air outlet pipe 106 and the air inlet pipe 105 with magnets 112 positioned on the surface, and FIG. 1E1 exemplarily illustrates is an enlarged view of the portion marked A in FIG. 1A which shows a perspective view of an embodiment of one of the air outlet pipe 106 and the air inlet pipe 105 with six magnets 112 positioned on the surface. The term "magnets" will be, herein after referred to as "Neodymium iron boron blocks". The furnace apparatus 100 disclosed herein is configured to incinerate solid waste, and comprises a generally chamber 101, a solid waste feed inlet 104, multiple air inlet pipes 105, and multiple air outlet pipes 106. The chamber 101 is generally of a square cross section, and comprises an upper pyrolysis section 102 and a lower combustion section 103, and the solid waste feed inlet 104 is positioned at an upper portion 101*a* of the chamber 101 configured to feed solid waste to the lower combustion section 103. The air inlet pipes 105 are fixedly connected to a lower portion 101*b* of the chamber 101 to receive air for combustion of the solid waste within the lower combustion section 103. As shown in FIG. 1B, the air is received in a controlled maimer via air inlet valves 105*a* positioned distally to the air inlet pipes 105. The air outlet pipes 106 are fixedly connected to the lower portion 101*b* of the chamber 101 and opposingly positioned to the air inlet pipes 105 to exhaust combusted air from the lower combustion section 103, where multiple Neodymium Iron Boron blocks 112 are operably attached on the air inlet pipes 105 and the air outlet pipes 106. In an embodiment, the air outlet pipe 106 and the air inlet pipe 105 are configured to be attached with at least pair of Neodymium iron boron blocks 112 on opposing sides, as shown in FIG. 1C, and six Neodymium iron boron blocks 112 on opposing sides alternatively, as shown in FIG. 10. The paramagnetic oxygen present in the received air is concentrated via the Neodymium Iron Boron blocks 112, and the concentrated oxygen is introduced into a plasma generated within the lower combustion section 103 to accelerate the combustion process, and to oxidize toxic matter present in the solid waste. In an embodiment, the furnace apparatus 100 further comprises an ignition chamber 107 positioned adjacent to the lower combustion chamber 103, where an ignition starter material is loaded into the ignition chamber 107, and ignited to be introduced into the lower combustion chamber 103 for the combustion of the solid waste. The ignition starter material is, for example, camphor and dry wood. In an embodiment, the furnace apparatus 100 further comprises a drip pan chamber 108 positioned below the lower combustion chamber 103, where the drip pan chamber 108 is configured to collect the combustion waste which drips out of the lower combustion chamber 103. In an embodiment, the furnace apparatus 100 further comprises a bottom stirrer 109 positioned at a lower section 101*b* of the lower combustion chamber 103, where the bottom stirrer 109 is configured to stir the solid waste during the combustion process. In an embodiment, the furnace apparatus 100 further comprises coil sections 110 positioned within the upper pyrolysis section 102 and the lower combustion section 103, where the coil sections 110 are configured to transfer the heat via conduction to assist in the combustion of the solid waste and to prevent the overheating of the walls of the chamber 101. In an embodiment, the furnace apparatus 101 further comprises a walk way positioned adjacent to the chamber 101 configured to allow a user to climb above the chamber 101 and open the top covering plate 117 as shown in FIG. 2, of the solid waste feed inlet 104 to feed in the solid waste. The other components of the furnace apparatus 100 comprising the upper airlock 112, the bottom air lock 113, and the combusted air exhaust assembly 114, are disclosed in the FIGS. 2-8. As used herein, the term "plasma" refers to an ionized gas, in which some electrons are removed from atoms and molecules and are free to move, which is created by permanent Neodymium Iron Boron blocks 115 at high temperatures, of about 400 degrees C. When a small amount of oxygen is absorbed into the plasma, highly reactive, negatively charged oxygen ions, that is, the atoms and molecules that have lost electrons are positive ions which are positively charged; and electrons that have been removed are negative ions which are negatively charged are formed. This oxygen with negative ions is highly oxidative, thus decomposing dioxins and other harmful compounds by oxidation. Further, as shown in FIG. 1C which illustrates is an enlarged view of the portion marked A in FIG. 1A which shows a perspective view of the air outlet pipe 106 and the air inlet pipe 105 with Neodymium Iron Boron blocks 115 positioned on the surface. The air outlet pipe 106 or the air inlet pipe 105 is bored open on predefined sections as shown in FIG. 1C, and then Neodymium Iron Boron blocks 115 are positioned over the open portions 116 and connected to the lower section 101*b* of the chamber 101 to be in communication with the lower combustion chamber 103. The Neodymium Iron Boron blocks 115 are used because of the paramagnetic and diamagnetic nature of the gasses present in the air being received inside the lower combustion chamber 103 via the air inlet pipe 105, therefore oxygen being paramagnetic in nature is attracted and gets concentrated in the received air for combustion therefore increasing the rate of combustion, while the diamagnetic nitrogen gas is repelled due to magnetic action. FIG. 2 exemplarily illustrates a side perspective of a solid waste feed inlet 104 of the furnace apparatus 100. In an embodiment, the solid waste feed inlet 104 is defined as a feed chute of a generally cuboidal shape comprising a top covering plate configured to open the feed chute to receive the solid waste, and a toggle clamp 118 to close and rigidly shut the top covering plate 117 in a closed position during the combustion process inside the lower combustion chamber 103. Further, the furnace apparatus 100 comprises a stopper plate 119 with a rubber mounting 120 configured to rigidly adjust the top covering plate 117 in position. FIG. 3 exemplarily illustrates a side perspective of an upper airlock 112 of the furnace apparatus 100. In an embodiment, the furnace apparatus 100 further comprises an upper airlock 112 positioned below the solid waste feed inlet 104, where the upper airlock 112 is configured to prevent the flow of exhaust air from within the lower combustion chamber 103 into the solid waste feed inlet 104. The upper airlock comprises an airlock shaft 121 which receives the drive for the upper airlock 112, the covering plate 122 to cover the upper airlock 112 frontally, bearing member 123 to take the load of the airlock shaft 121, and the circular plate 124 to actuate the upper airlock 112 manually. FIG. 4 exemplarily illustrates a side perspective of a bottom airlock 113 of the furnace apparatus 100. In an embodiment, the furnace apparatus 100 further comprises a bottom airlock 113 positioned below the lower combustion chamber 103, where the bottom airlock 113 is configured to prevent expulsion of combusted air through a lower section of the lower combustion chamber 103. The bottom airlock 113 also comprises a covering plate 125, a bottom airlock shaft 126, bearing members 127 to take the load of the bottom airlock shaft 126, and a stirrer strip 128. FIG. 5 exemplarily illustrates a side perspective of a chamber 101 of the furnace apparatus 100. The chamber 101 is used to house the sub components of the furnace apparatus 100. The chamber 101 comprises an outer steel plate 129, an inlet section 130 for positioning air inlet pipes 105, a transition cone 131 positioned upwardly to the chamber 101 to exhaust the smoke, and a mouth plate 132 proximal to the pyrolysis section 102 of the chamber 101. FIG. 6 exemplarily illustrates a side perspective of a combusted air exhaust assembly 114 of the furnace apparatus 100. In an embodiment, the furnace apparatus 100 further comprises a combusted air exhaust assembly 114 which comprises a chimney 133, a blower fan 134, and a scrubber 135. The chimney 114 is upwardly extending from the air outlet pipes 106 and in fluid communication with the lower combustion chamber 103. The blower fan 134 is positioned within the chimney 133 at a predefined position, where the blower fan 134 is configured to provide an induced draft to suction and exhaust the combusted gasses from the lower combustion chamber 103, and the scrubber 135 is positioned at a predefined distance above the blower fan, 134 where the scrubber 135 is configured to separate particulate matter from the exhausted combusted air. As the magnets 112 induce a controlled oxygen flow and destroys any dioxin formation, there is no harmful exhaust gasses, but in additionally, the scrubber 135 enables to remove almost 100 percent of the harmful exhaust gasses from the furnace apparatus 100. In an example, the working principle of the furnace apparatus 100 depends on closed chamber destruction of waste with plasma and ionization techniques at "oxygen starved" condition. The decomposition temperature of the solid waste is around 350 to 450 Degree Celsius and depends on the solid waste input. The furnace apparatus 100 does not require electric, other power or fuel for organic substances for decomposition. The Process Waste has to be feed into the lower combustion section 103 of furnace apparatus 100 at uniform intervals. At the initial stage requires start up fire by using camphor or dry wood afterwards destruction starts slowly by splitting the molecules into atoms. These atoms further ionized as electron, proton and neutron and this state is called as "plasma state" and separated electron change to "accelerated electron" with strong energy. On the other side a small amount of atmospheric air is allowed to pass through strong magnetic field via the magnetically defined air inlet pipes 105 into oxygen starved lower combustion section 103. During this operation oxygen molecule split into elemental oxygen with negative charge. This atomic oxygen is to oxidize perfectly organic surface and change organic matter to separate organic oxide. Therefore reaction is induced by exothermic phenomenon, thermal condition around 200 degree Celsius is needed to accelerate reaction which can achieve by initial decomposition. From 200 degree Celsius, by initial firing, to a range of 350 to 650 degree Celsius in the furnace apparatus 100 by plasma, ionization and thermal Vibration will achieve. The decomposition of waste takes place on bed wise so that heat energy developed may not be continuous. At the bottom of the lower combustion section 103 or the destruction chamber a tubular type radiator which makes buried near the lower layer of deposited ash and ash will be separated. The waste heat is recovered through a tubular heat sink arranged near the upper layer of deposited ash of a hearth center section of said combustion chamber 101 and the hearth periphery and the entire structure will have good heat transfer potential. As compared to a conventional incinerator which requires a source of energy to attain the temperature, the furnace apparatus 100 disclosed here does not use any source of energy. The waste heat is recovered back and supply to the wet waste where the moisture content is reducing phenomenally. The flue gas emission from the lower combustion section 103 is releasing with natural draft. The emission may contain some toxic components like Dioxin and Furan, Heavy metals, Nitrogen Oxides etc. The toxic components are destructed by using external Dry scrubber 135 and Moisture arrestor. The dry scrubber 135 which will be connected through Moisture arrestor where moisture content in the smoke condensed and remaining passes through 3 stage of filter called Pre-filter washable type mesh with activated carbon granules which removes odors and second stage with supported pleat media helps maintain a compact unitized structure under variable air velocities. The third stage of filter called fine filters, these extended surface rigid cell filters provide high efficiency removal of multiple contaminants for a variety of application. The filters use Carbon Web filters media containing 60% activity granular activated carbon to remove odors and gases including dangerous pollution like dioxin and furan other pollution, activated Alumina impregnated with 5% potassium permanganate (KMnO4) to remove odors and light gasses. By doing this smoke will be completely removed by filter with addition small fan pulls out the smoke where no smoke is visible and eliminate the reformation of Dioxin and Furan occurs and the clean gas is dispersing into atmosphere. The non-combustible waste and ash is collected separately and stored in well-defined area for the disposal into secured landfill. The ash quantity generation should be in the ratio of about 1/300. The foregoing examples have been provided merely for the purpose of explanation and are in no way to be construed as limiting of the present concept disclosed herein. While the concept has been described with reference to various embodiments, it is understood that the words, which have been used herein, are words of description and illustration, rather than words of limitation. Further, although the concept has been described herein with reference to particular means, materials, and embodiments, the concept is not intended to be limited to the particulars disclosed herein; rather, the concept extends to all functionally equivalent structures, methods and uses, such as are within the scope of the appended claims. Those skilled in the art, having the benefit of the teachings of this specification, may affect numerous modifications thereto and changes may be made without departing from the scope and spirit of the concept in its aspects.

DETAILED DESCRIPTION

Embodiments provide improved systems and methods to reduce and remove particulate matter and chemical pollutants from flue gasses. Embodiments encompass a system for incinerating waste and cleaning the resultant flue gasses. Embodiments may help to remove and destroy particulate matter and chemical pollutants such as dioxins from flue gasses, and reduces or eliminates soot, and combustible gasses such as SO2 and NOX emissions. Certain embodiments may help to completely destroy the particulate matter and chemical pollutants.

Embodiments may be an improvement to the disclosure of PCT patent application PCT/US/1644931; and U.S. Pat. No. 9,518,733. One element of embodiments is adapted to be used with the Furnace Apparatus system and used at the initial flow stage at which stage air flow into the furnace is controlled.

The system may work independently of the previous Furnace Apparatus, but in the present disclosure is described as an improvement to the Furnace Apparatus system.

The below improvements may be used separately or all together in with the furnace apparatus.

In a first improvement, a "Buxbaum" magnetic air separator system is used within the core part in the magnetic field generator of the air input, or replaces the magnetic field generator and air input elements. This essentially updates the previous magnetic-filed generator design for the Furnace Apparatus system. The magnetic air separator improves the efficiency of concentrating paramagnetic oxygen thereby increasing oxygen concentration in the plasma combustion chamber and increasing efficiency of combustion.

Figure 1A:
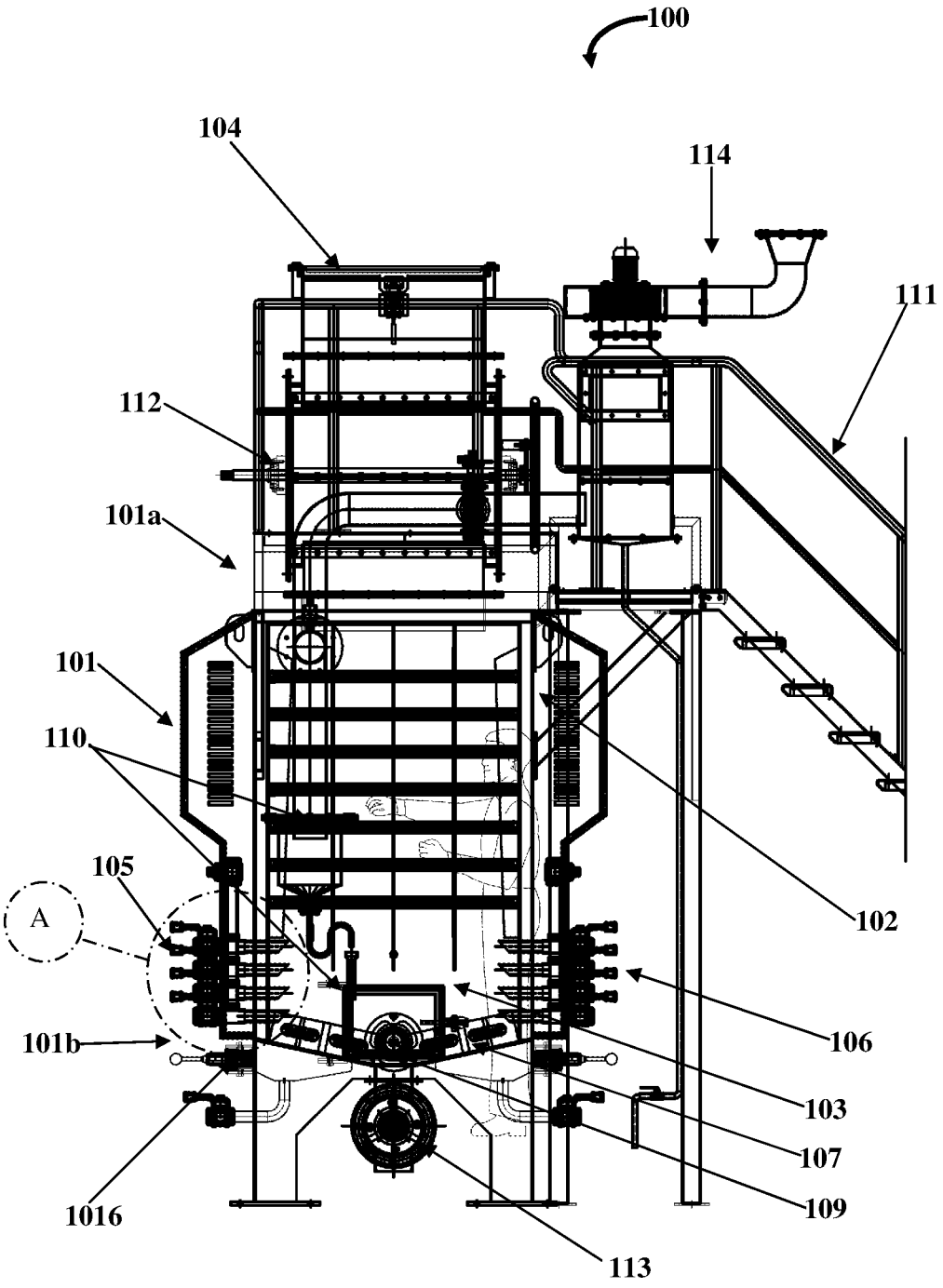
FIG. 1A exemplarily illustrates is a front perspective of the furnace apparatus.
Figure 1B:
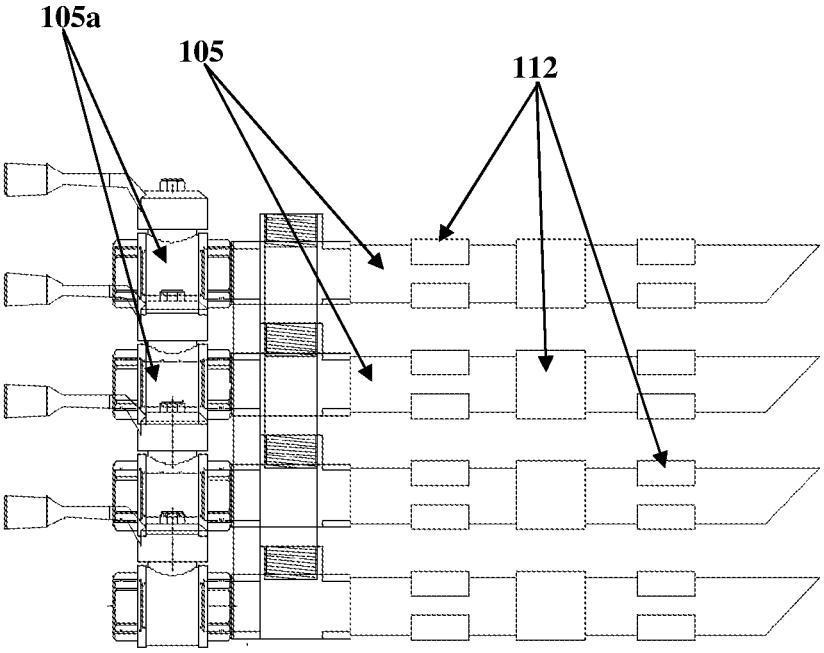
FIG. 1B exemplarily illustrates is an enlarged view of the portion marked A in FIG. 1A which shows a perspective view of the air inlet pipe with magnets positioned on the surface.
Figure 1C:
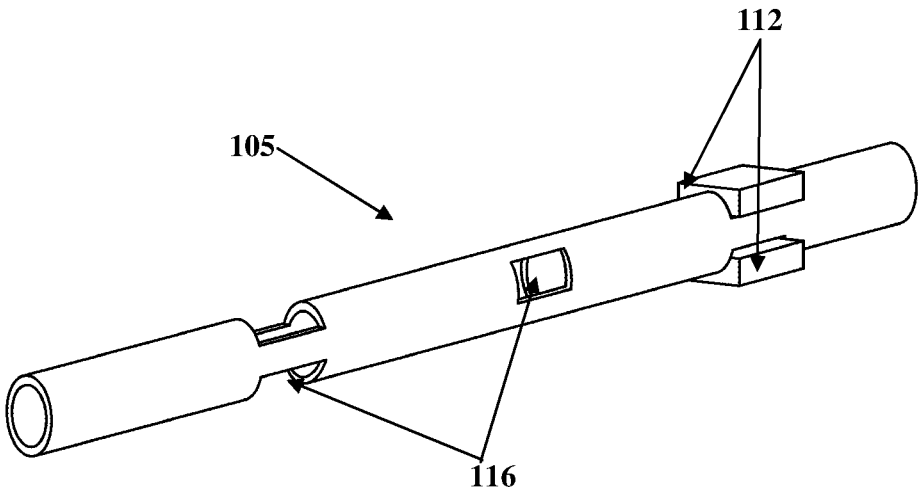
FIG. 1C exemplarily illustrates is an enlarged view of the portion marked A in FIG. 1A which shows a perspective view of one of the air outlet pipe and the air inlet pipe with magnets positioned on the surface.
Figure 1D:
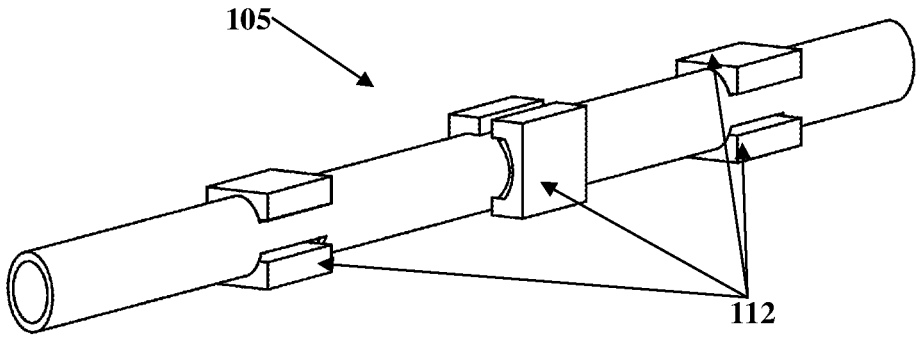
FIG. 1D exemplarily illustrates is an enlarged view of the portion marked A in FIG. 1A which shows a perspective view of an embodiment of one of the air outlet pipe and the air inlet pipe with six magnets positioned on the surface.
Figure 2:
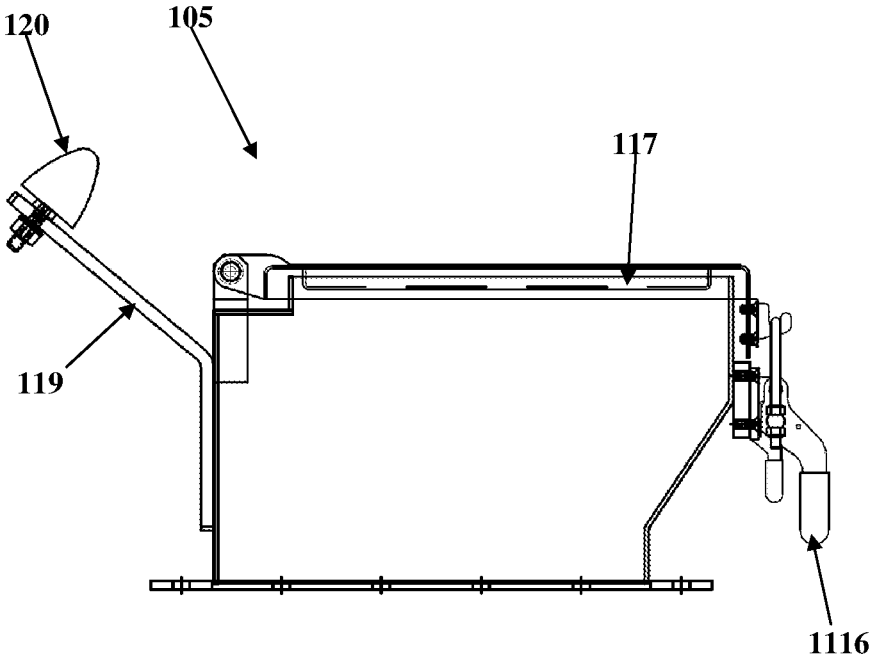
FIG. 2 exemplarily illustrates a side perspective of a solid waste feed inlet of the furnace apparatus.
Figure 3:
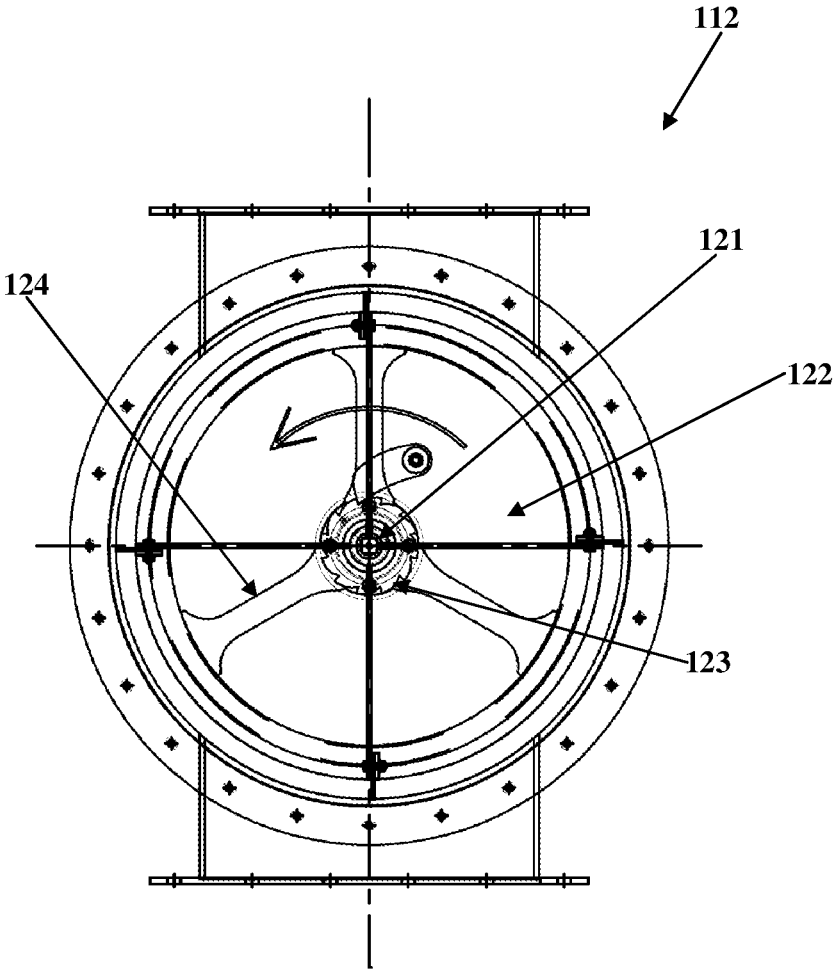
FIG. 3 exemplarily illustrates a side perspective of an upper airlock of the furnace apparatus.
Figure 4:
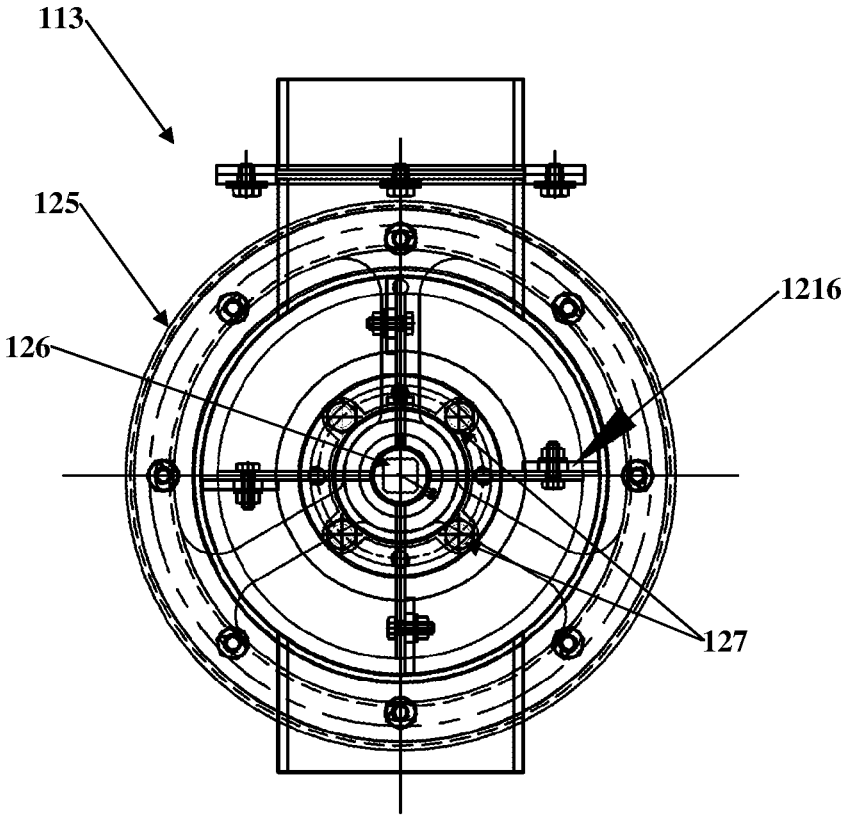
FIG. 4 exemplarily illustrates a side perspective of a bottom airlock of the furnace apparatus.
Figure 5:
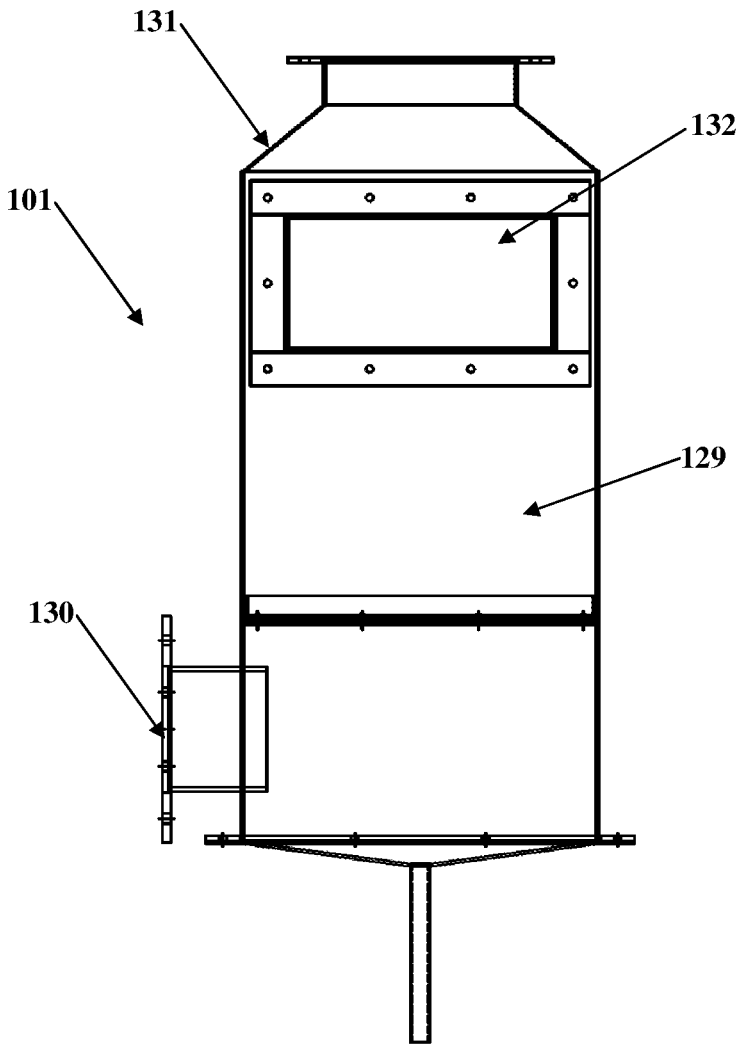
FIG. 5 exemplarily illustrates a side perspective of a chamber of the furnace apparatus.
Figure 6:
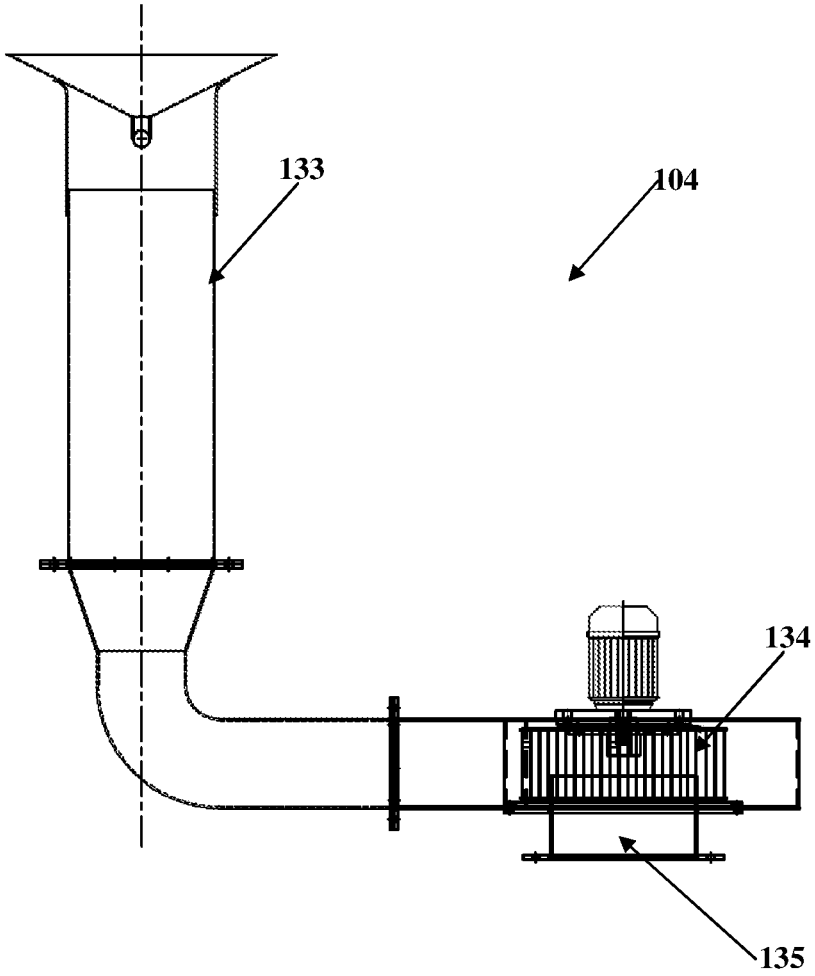
FIG. 6 exemplarily illustrates a side perspective of a combusted air exhaust assembly of the furnace apparatus.
Figure 7:
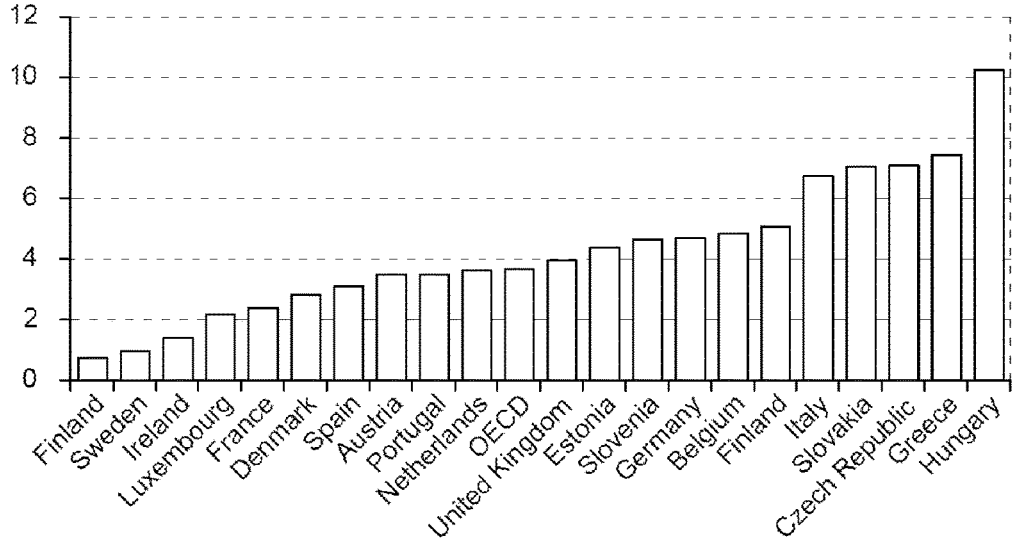
FIG. 7 Estimated cost of air pollution as % of GDP, from OECD report 2015.
Figure 8:
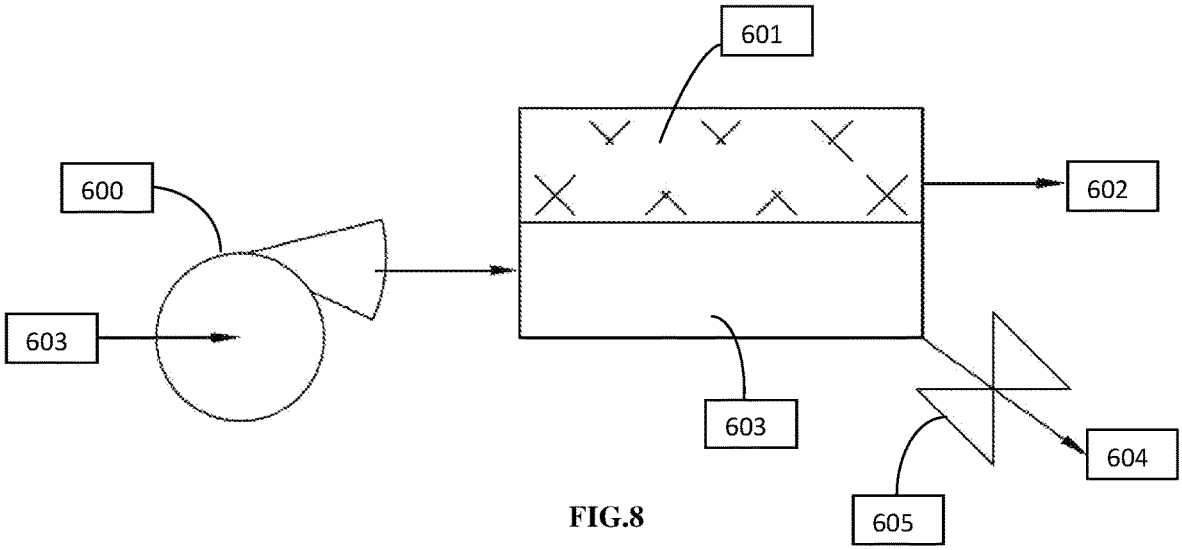
FIG. 8 Basic Buxbaum design magnetic field air separator separating $O_2$ from $N_2$. 603=air blower, 601=portion of containment box with magnetic field, 602=direction of flow of oxygen-enriched air, 603=portion of containment box without magnetic field, 604=direction of flow of Nitrogen-enriched air, 605=flow restrictor.
Figure 9:
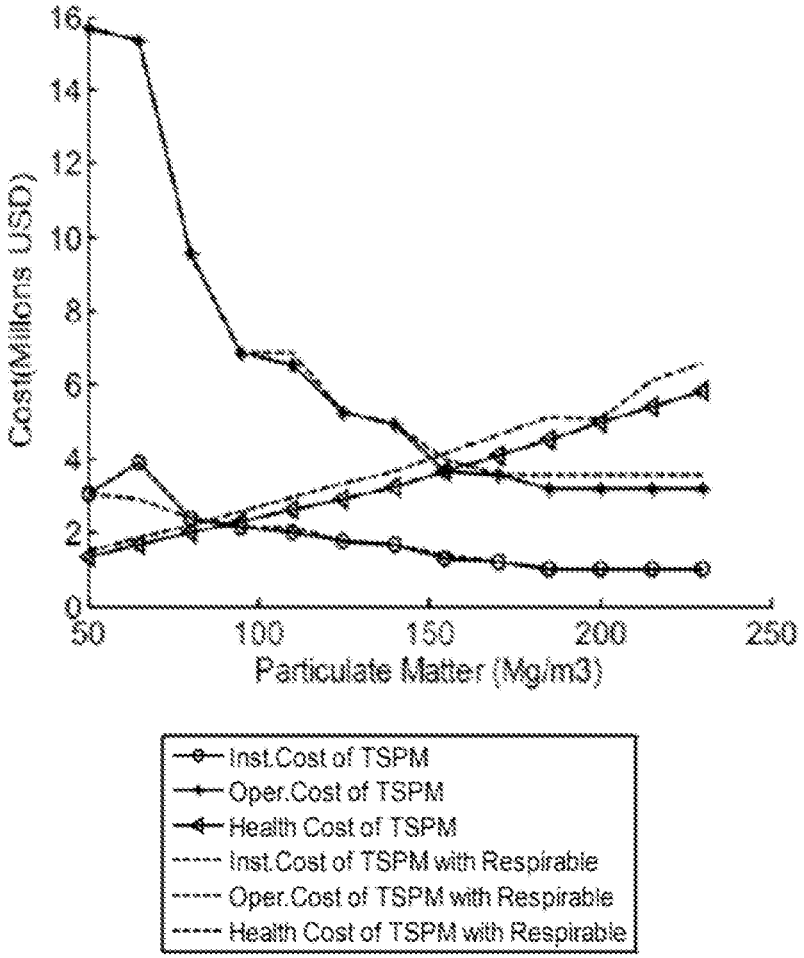
FIG. 9 Cost of particulate emissions. TSMP=Toxic Substances Management Policy.
Figure 10:
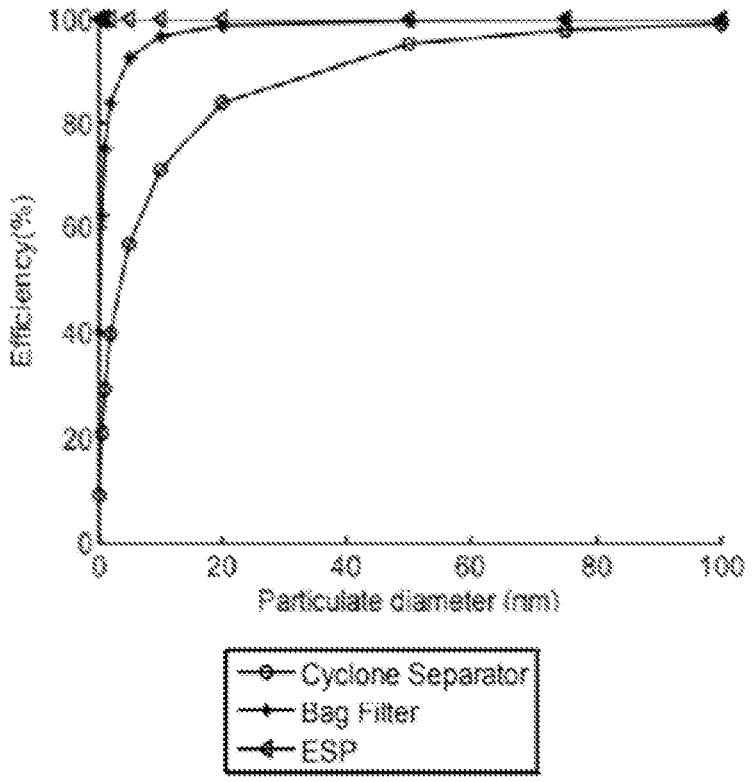
FIG. 10 Particle diameter (>100 mm) vs. efficiency of removal using various methods.
Figure 11:
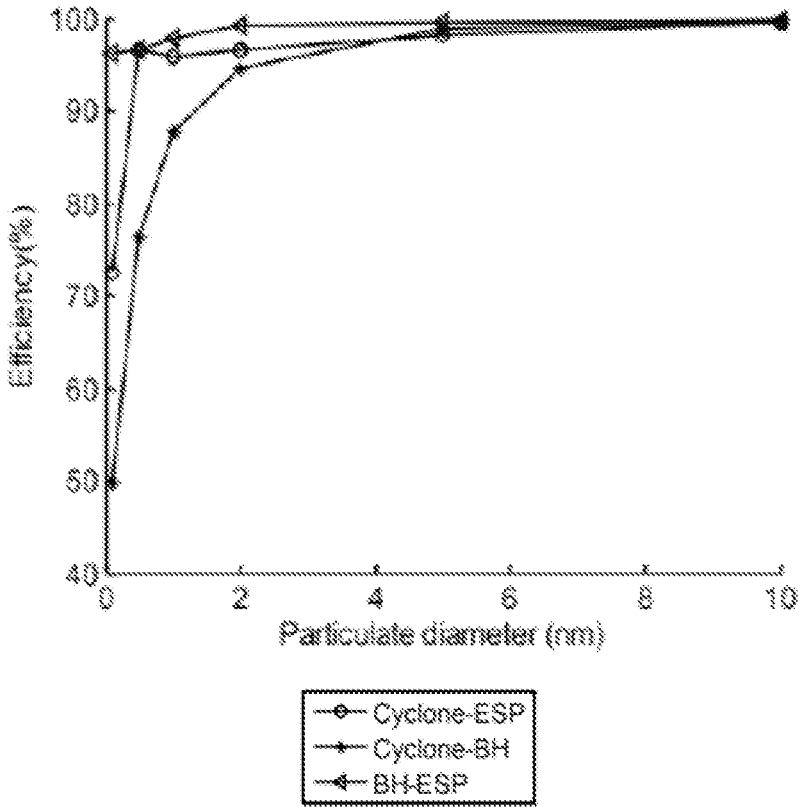
FIG. 11 Particle diameter (>10 mm) vs. efficiency of removal using various methods.
Figure 12:
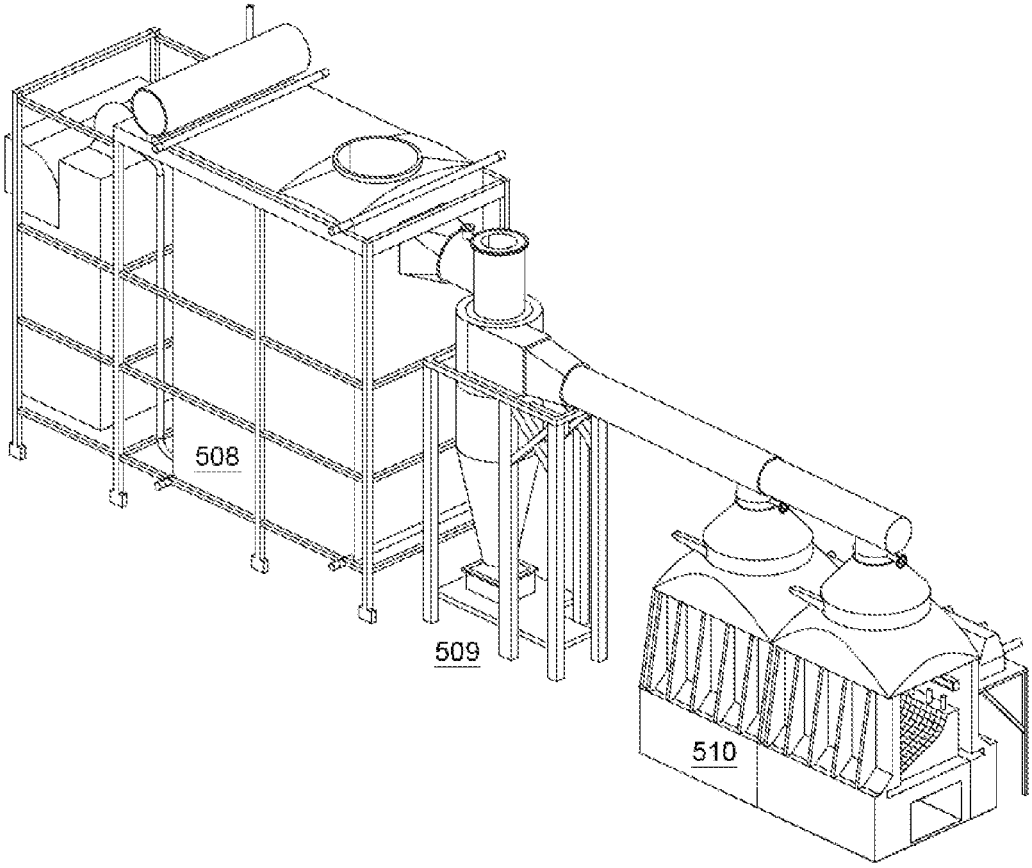
FIG. 12 Shows a high level isometric design overview of the furnace showing the emission control system (508) attached to a cyclone fan element (509) which is subsequently attached to the grate component (510).
Figure 13:
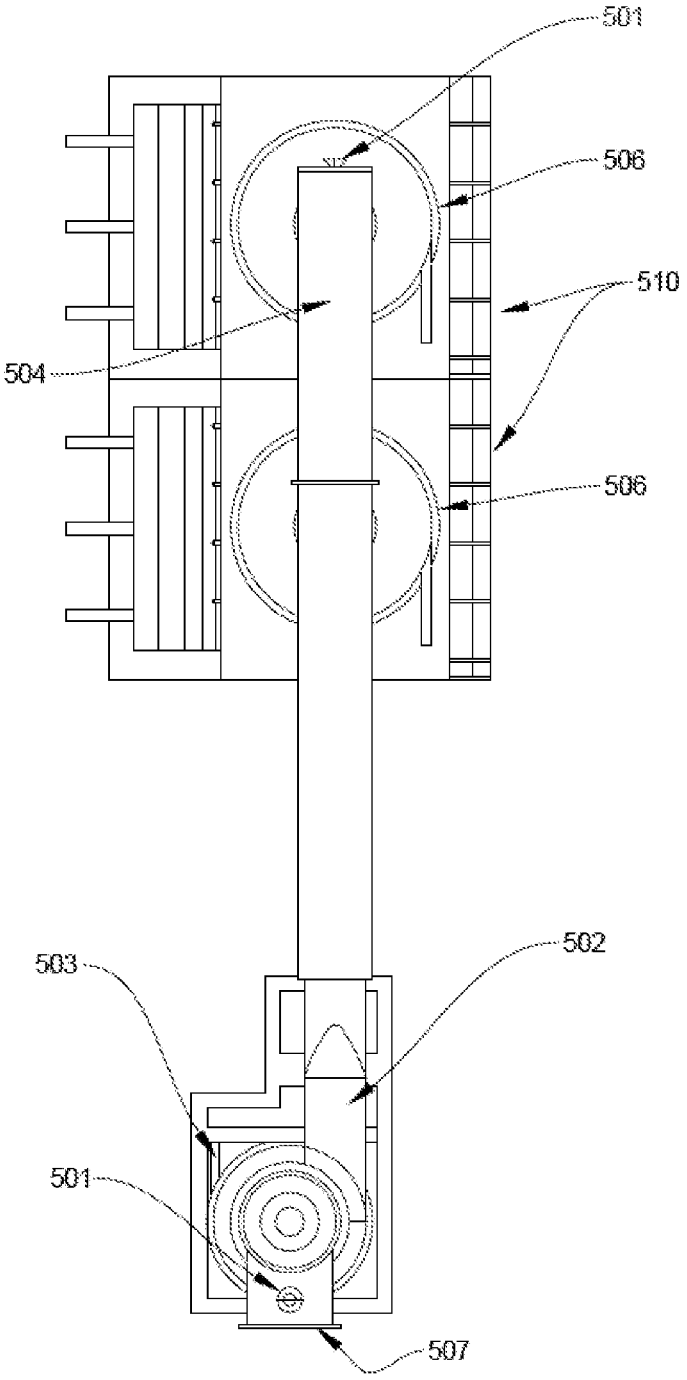
FIG. 13 Shows a top view of the cyclone fan and the grate system (510) and 503=secondary air inflow, 501=gate valve, 507=cyclone, 507=cyclone entrance. Exemplary dimensions 207 cm long with a 71 cm wide grate and a 33 cm wide cyclone.
Figure 14:
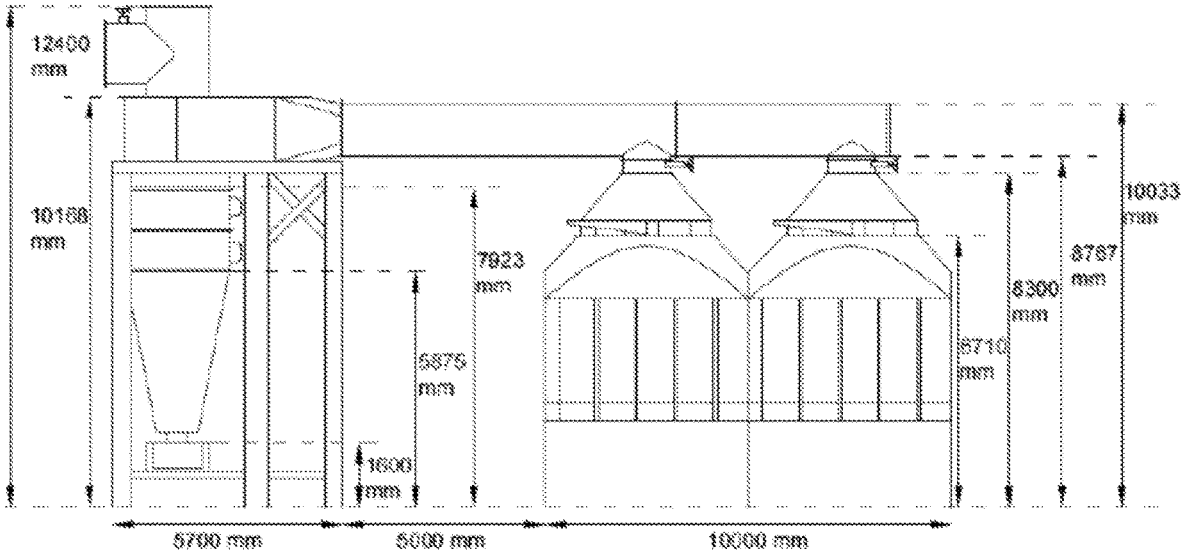
FIG. 14 Shows a side-on orthogonal view of the cyclone fan and the grate system with various dimensions.
Figure 15:
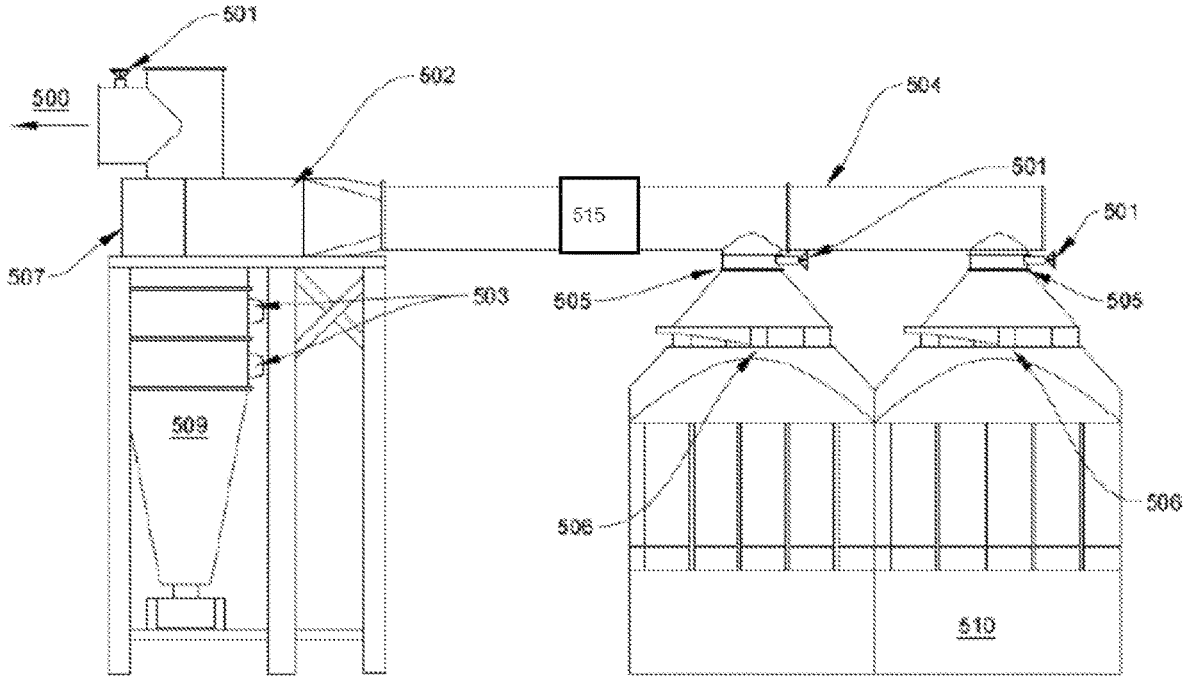
FIG. 15 Shows a side-on orthogonal view of the cyclone fan feeding into the grate (510) with a Venturi ejector (515) positioned between them, and direction of flow to boiler shown. 501=gate valve, 505=primary chamber outlet (e.g., Primary Chamber Outlet 600 mm internal diameter opening with 279 mm [11"] refractory surrounding it), 506=over-fire air ring (e.g., Overfire Air Ring 2700 mm internal diameter with 279 mm [11"] refractory surrounding it), 510=grate, 503=secondary air inflow, 504=connection to cyclone (e.g., Connection to Cyclone 700 mm internal diameter opening with 279 mm [11"] refractory surrounding it), 507=cyclone (e.g., 2000 mm internal diameter with 279 mm [11"] refractory), 507=cyclone entrance (e.g., Cyclone Entrance 1000 mm×707 mm rectangle opening with 279 mm [11"] refractory surrounding it).
Figure 16A:
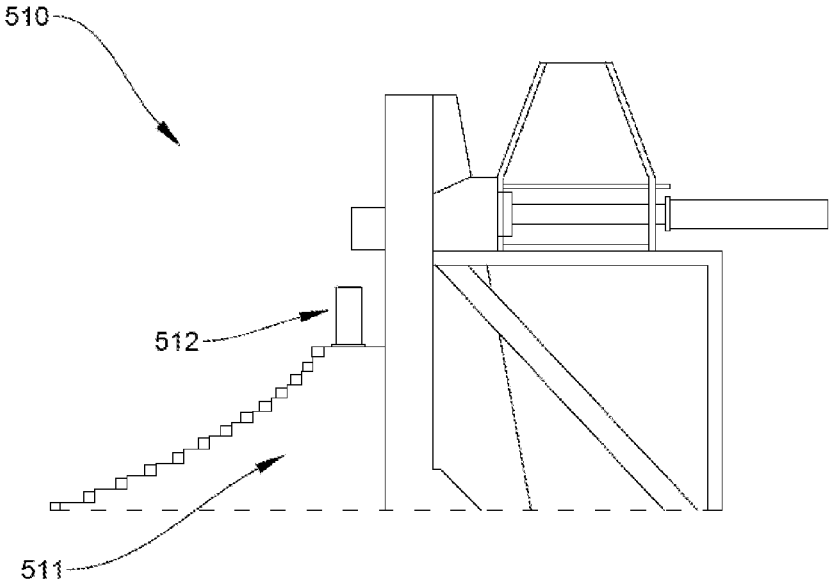
FIG. 16A Shows an isometric view of the grate system with grate boxes (511) (e.g., MCS-30).
Figure 16B:
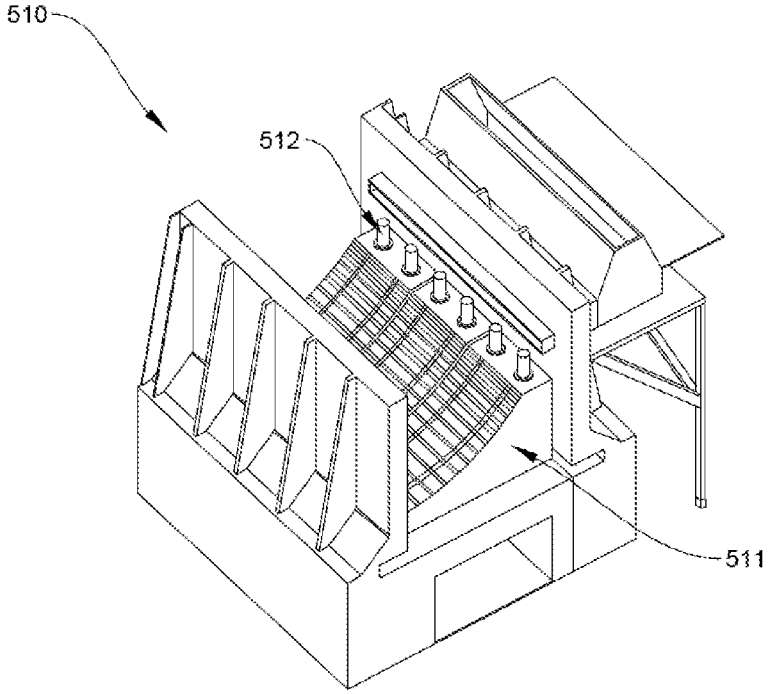
FIG. 16B Shows a side view of the grate system with grate boxes (511).

A Buxbaum magnetic air separator uses a magnetic field to concentrate Oxygen. See http://www.rebresearch.com/blog/maanetic-separation-of-air/, Robert E. Buxbaum, Oct. 11, 2017. Oxygen is paramagnetic and attracted by a magnet. Nitrogen is diamagnetic, repelled by a magnet. See FIG. 8 (Basic Buxbaum design air separator).

The above diagram shows a magnetic $O_2$ concentrator. The dotted line is a permeable membrane. The $O_2$ concentrator increases the concentration of Oxygen that is funneled into the plasma chamber where combustion occurs.

In a second improvement, the inner wall of the plasma chamber is similar to that described in PCT/US/1644931, but is lined with a novel heater structure or mechanism wherein the heating elements are composed of a nickel-chromium alloy conductor coated with a magnesium and/or graphite composite coating. This provides thermal insulation and facilitates heat retention within the wall of the plasma chamber. They may used or adapted for insulation and passive absorption and radiation of heat, or can they also be used to heat the furnace initially (as a pre-heater) by passing a current through them.

In various embodiments, the whole inner wall of the combustion chamber will be insulated with silica carbide insulation ranging from 8 inches to 16 inches thick, depending on capacity of the machine. In other embodiments only a portion of the inner chamber wall is insulated with silica carbide insulation.

In some embodiments, the plasma chamber is partially lined with the proprietary heating filament (process heater), and in other embodiments it is substantially lined with the proprietary heating filament. In yet other embodiments, the proprietary heating filament is simply present within some area of the plasma chamber. The process heater may, in some embodiments, also function to ensure the temperature is constant and does not fluctuate even when there is no fuel in the furnace. In other embodiments, the as well as being used as conductor, the element will be used as a preheater during the initial heating stage. With the addition of ceramic-covered copper and/or brass coils, heat transfer and loss from the inner wall towards the outer wall is reduced or prevented. In addition, a silica carbide coating (for example about 6 inches thick) is present to eliminate any heat and energy loss from the plasma chamber.

Thus, certain embodiments may encompass an improvement to the furnace apparatus of PCT/US/1644931, comprising nickel-chromium alloy conductors coated with a magnesium and/or graphite composite positioned within the lower combustion section (103). These conductors are adapted to retain and conduct heat. In other embodiments, they are adapted to conduct an electric current from an external source to provide heat in the combustion chamber. The lower combustion section (103), may be fully or may be at least partially encapsulated with an insulating silica carbide coating. Silica carbide may help to retain the heat inside the chamber for better waste processing and avoid any heat loss. The lower combustion section (103) may be partially of fully insulated with silica carbide insulation with a thickness ranging from 8 inch to 16 inch depending on capacity of the machine.

In various embodiments, the nickel-chromium alloy conductors (which may be coated with a magnesium and/or graphite composite) are located within the grate of the furnace (at the bottom of the furnace) as well as on the surrounding wall in between the silica carbide coating and the stainless-steel wall.

In a third improvement, once the emissions (flue gas) come out of the exhaust, a cyclone fan mechanism (air blower) is used propel and suck in all the carbon and Volatile Organic Contents (VOC). A cyclone may be used to separate the particulate matter by introducing magnetized air into a vortex. Particulate matter that falls to the bottom.

In a forth improvement, the exhaust gasses are heated by the proprietary process heater up to about 1200° C. (for example from 400 to 2000° C., or 600 to 1800° C., or 800 to 1600° C., or 1000 to 1400° C., or 1200 to 1300° C.). The proprietary process heater is an add-on to the cyclone mechanism to provide a $2^{nd}$ stage combustion. This results in much cleaner flue gasses and lower emissions of pollutants and undesirable emission products. The process of embodiment may help to ensure that the solution complies with majority of US and European emission pollution control standards, including US state standards in California. In various embodiments, the flue gasses may be heated by the proprietary process heater to heat up the gasses to about 1000° C., or in other embodiments from 500° C. to 2000° C., 750° C. to 1500° C., or 900° C. to 1200° C. This additional heating may result in cleaner flue gas.

In a fifth improvement, the flue exhaust gas enters a Zeolite chamber. Zeolites are microporous, aluminosilicate minerals commonly used as commercial adsorbents and catalysts. The structure of the Zeolite chamber is generally cylindrical in form with an exemplary diameter of between 1000 mm to 4000 mm and a length from 1000 mm to 5000 mm. The diameter may in other embodiments be from 500 to 10000 mm in diameter, or 750 to 8000 mm or 900 mm to 6000 mm or 1000 to 5000 mm. The Zeolite absorbs residual moisture content removing from 50% to 100% of the residual moisture. One or a number of low speed fans are used to guide the gasses to the next processing stage.

In a sixth improvement, after (or during) the step of moisture absorption, the gasses are subjected to an ultrasonic frequency to eliminate any residual contaminants, so that the gas is completely cleaned before venting to the environment. The ultrasonic means/unit works by capturing any of vapor from the zeolite chamber and turning it into a fine mist prior to release into the air. The unit has a small plate made of ceramic that vibrates at the frequency of about 1.7 MHz or at any ultrasonic frequency sufficient to produce a mist, for example from 1 MHz to 3 MHz, from 1.2 MHz to 2.5 MHz or from 1.5 to 2 MHz.

In some embodiments, there are no detectable dioxins, and no detectable particles of a size above 10 μm, or in other embodiments none larger than 2.5 μm.

Additionally, in the new embodiment, a cyclone mechanism may be fitted to the exhaust. The cyclone contains an outer vortex of downward flowing air and an inner vortex of upward flowing air to propel the flue gasses, and the carbon and Volatile Organic Contents (VOC) into a process heater.

The improvements disclosed herein increase the efficiency of the Furnace Apparatus system and reduces the need of any additional scrubbing system.

Example 1

An embodiment encompasses a furnace apparatus configured to incinerate solid waste, comprising; a chamber comprising an upper pyrolysis section and a lower combustion section; a solid waste feed inlet positioned at an upper portion of the chamber configured to feed solid waste to the lower combustion section; a plurality of air inlet pipes fixedly connected to a lower portion of the chamber to receive air for combustion of the solid waste within the lower combustion section; and a plurality of air outlet pipes fixedly connected to the lower portion of the chamber and opposingly positioned to the air inlet pipes to exhaust combusted air from the lower combustion section, wherein a plurality of magnets are operably attached on the air inlet pipes and the air outlet pipes, wherein paramagnetic oxygen present in the received air is concentrated via the magnets, and the concentrated oxygen is introduced into a plasma generated within the combustion section to accelerate the combustion process, and to oxidize toxic matter present in the solid waste; the improvement comprises nickel-chromium alloy conductors coated with a magnesium and/or graphite composite positioned within the lower combustion section (103), which conductors are adapted to retain heat and/or to conduct an electric current from an external source to provide heat in the combustion chamber. In this example, the lower combustion section (103), can be totally or at least partially encapsulated with an insulating silica carbide coating. The improved furnace apparatus may be manufactured with the lower combustion section (103), is at least partially encapsulated with an insulating silica carbide coating. The exhaust assembly (114) may further be connected to a fan mechanism that propels the flue gasses into a process heater adapted to heat up the flue gasses up to about 1200° C. The improved furnace apparatus may produce an ultimate exhaust gasses containing no detectable dioxins and no detectable particles of a size above 10 μm, or in other embodiments none larger than 2.5 μm.

Example 2

In a related example, the exhaust (114) of the furnace apparatus is further connected to a fan mechanism that propels the flue gasses into a process heater adapted to heat up the flue gasses up to about 1200° C. The fan may be a cyclone fan producing an outer vortex of downward flowing air and an inner vortex of upward flowing air.

Example 3

A further example includes a low speed fan that propels the gasses from the process heater into a Zeolite chamber to absorb any residual moisture from the gasses.

Example 4

Another example of an improved system adds a chamber fitted with ultrasonic generators wherein the gasses are subjected to an ultrasonic frequency to eliminate any residual contaminants.

Example 5

In a separate example, the improved furnace apparatus, which in previous disclosures used magnets or magnetic field generators to magnetize paramagnetic oxygen so as to funnel it into the combustion chamber, uses a magnetic air separator, such as a Buxbaum air separator, in functional communication with the air inlet pipes, to concentrate oxygen and direct it into the combustion chamber (103).

General Disclosures

All publications referred to in this disclosure are incorporated by reference for all purposes, this includes U.S. Pat. No. 9,518,733.

This specification incorporates by reference all documents referred to herein and all documents filed concurrently with this specification or filed previously in connection with this application, including but not limited to such documents which are open to public inspection with this specification. All numerical quantities mentioned herein include quantities that may be plus or minus 20% of the stated amount in every case, including where percentages are mentioned. As used in this specification, the singular forms "a, an", and "the" include plural reference unless the context clearly dictates otherwise. Thus, for example, a reference to "a part" includes a plurality of such parts, and so forth. The term "comprises" and grammatical equivalents thereof are used in this specification to mean that, in addition to the features specifically identified, other features are optionally present. For example, a composition "comprising" (or "which comprises") ingredients A, B and C can contain only ingredients A, B and C, or can contain not only ingredients A, B and C but also one or more other ingredients. The term "consisting essentially of" and grammatical equivalents thereof is used herein to mean that, in addition to the features specifically identified, other features may be present which do not materially alter the scope of the claims. The term "at least" followed by a number is used herein to denote the start of a range beginning with that number (which may be a range having an upper limit or no upper limit, depending on the variable being defined). For example, "at least 1" means 1 or more than 1, and "at least 80%" means 80% or more than 80%. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Where reference is made in this specification to a method comprising two or more defined steps, the defined steps can be carried out in any order or simultaneously (except where the context excludes that possibility), and the method can optionally include one or more other steps which are carried out before any of the defined steps, between two of the defined steps, or after all the defined steps (except where the context excludes that possibility). When, in this specification, a range is given as "(a first number) to (a second number)" or "(a first number)-(a second number)", this means a range whose lower limit is the first number and whose upper limit is the second number. For example, "from 40 to 70 microns" or "40-70 microns" means a range whose lower limit is 40 microns, and whose upper limit is 70 microns.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

The invention claimed is:

1. A furnace apparatus configured to incinerate solid waste, comprising;

a chamber comprising an upper pyrolysis section and a lower combustion section;

a solid waste feed inlet positioned at an upper portion of the chamber configured to feed solid waste to the lower combustion section;

a plurality of air inlet pipes fixedly connected to a lower portion of the chamber to receive air for combustion of the solid waste within the lower combustion section; and a plurality of air outlet pipes fixedly connected to the lower portion of the chamber and opposingly positioned to the air inlet pipes to exhaust combusted air from the lower combustion section, wherein a plurality of magnets are operably attached on the air inlet pipes and the air outlet pipes, wherein paramagnetic oxygen present in the received air is concentrated via the magnets, and the concentrated oxygen is introduced into a plasma generated within the combustion section to accelerate the combustion process, and to oxidize toxic matter present in the solid waste;

the furnace apparatus further comprising nickel-chromium alloy conductors coated with a magnesium and/or graphite composite positioned within the lower combustion section, wherein the conductors are adapted to retain and conduct heat, and wherein the apparatus further comprises a chamber fitted with an ultrasonic generator wherein gasses are subjected to an ultrasonic frequency, wherein the ultrasonic generator is a vibrating ceramic plate.

2. The furnace apparatus of claim 1, wherein the conductors are adapted to conduct an electric current from an external source to provide heat in the combustion chamber.

3. The furnace apparatus of claim 1, wherein the lower combustion section, is at least partially encapsulated with an insulating silica carbide coating.

4. The furnace apparatus of claim 1, wherein the exhaust assembly is further connected to a fan mechanism that propels the flue gases into a process heater adapted to heat up the flue gasses up to about 1200° C.

5. The furnace apparatus of claim 4, wherein the fan is a cyclone fan producing an outer vortex of downward flowing air and an inner vortex of upward flowing air.

6. The furnace apparatus of claim 5, further comprising a low speed fan that propels the gasses from the process heater into a Zeolite chamber to absorb any residual moisture from the gasses.

7. The furnace apparatus of claim 6, further comprising a chamber fitted with ultrasonic generators wherein the gasses are subjected to an ultrasonic frequency to produce a fine mist from any vapour or liquid present.

8. The furnace apparatus of claim 7, wherein, after processing, the exhaust gasses contain no detectable dioxins and no detectable particles of a size above 10 μm, or in other embodiments none larger than 2.5 μm.

9. The furnace apparatus of claim 1, wherein the nickel-chromium alloy conductors coated with a magnesium and/or graphite composite line at least a portion of the inside of the lower combustion section.

10. The furnace apparatus of claim 1, wherein the nickel-chromium alloy conductors are adapted for thermal insulation and are positioned between a silica carbide coating and an outer stainless-steel wall.

* * * * *